United States Patent [19]

Kirkpatrick

[11] Patent Number: 5,029,407

[45] Date of Patent: Jul. 9, 1991

[54] BIPOD FOR ATTACHMENT TO A THOMPSON/CENTER CONTENDER PISTOL AND THE LIKE

[76] Inventor: Lloyd D. Kirkpatrick, Blewett Rte. P.O. Box 273, Uvalde, Tex. 78801

[21] Appl. No.: 562,332

[22] Filed: Aug. 3, 1990

[51] Int. Cl.[5] ..... F41A 23/10

[52] U.S. Cl. ..... 42/94

[58] Field of Search ..... 42/94; 89/37.04

[56] References Cited

U.S. PATENT DOCUMENTS

| | | | |
|---|---|---|---|
| 1,382,409 | 6/1921 | Butler | 42/94 |
| 1,426,967 | 8/1922 | Drescher | 42/94 |
| 2,807,904 | 10/1957 | Kreske | 42/94 |
| 3,007,581 | 11/1961 | Moore | 42/94 |
| 3,327,422 | 6/1967 | Harris | 42/94 |
| 3,938,273 | 2/1976 | Tellie | 42/94 |
| 4,625,620 | 12/1986 | Harris | 42/94 |
| 4,641,451 | 2/1987 | Harris | 42/94 |
| 4,776,124 | 10/1988 | Clifton | 42/94 |

*Primary Examiner*—Charles T. Jordan
*Attorney, Agent, or Firm*—J. Gibson Semmes

[57] ABSTRACT

A collapsible bipod for sidearms weapons characterized by extensible and retractable legs, contained in the forearm of the weapon.

3 Claims, 3 Drawing Sheets

BIPOD FOR ATTACHMENT TO A THOMPSON/CENTER CONTENDER PISTOL AND THE LIKE

BACKGROUND OF THE INVENTION

The invention in specific comprises a collapsible bipod which is secured as an integrated part of the forearm of a Thompson/Center Contender Super 14 Pistol. In use, the accuracy of the pistol may only be insured by providing a stable, solid resting place. The body mount and legs of the bipod are thus adapted to be set within a preformed wooden forearm and attached thereto in collapsible-extensible relation.

The prior art is best represented by the following U.S. Pat. Nos. : J. S. Butler, 1,382,409; W. J. Kresge, 2,807,904; G. Harris, 3,327,422; P. E. Kellie, 3,938,273; G. Harris, 4,625,620; G. Harris, 4,641,451.

In contrast to the prior art, the legs forming the bipod are extensible from and retractable into channels which are formed in the wooden forearm wherein they may be locked in position out of sight, when not in use. These retractable legs are releasable so that they may be flared left and right to a position thirty (30) degrees from center and there, locked into foreward tilt support position; appropriate extensible means for elevation adjustment are also provided.

SUMMARY OF INVENTION

The invention is a sidearm accessary, providing for the incorporation of forearm and a stable bipod appropriately fixed, by way of example, upon a Thompson/Center Contender Super 14 Pistol which is generally known as a single shot fourteen or sixteen inch barrel pistol. It provides a stable and adjustable resting place for the pistol as in target practice on range firing. The bipod is collapsible and retractable into the forearm, thus eliminating the need to carry other accessories into the field for contests and the like. Its primary legs are extensible to a forward tilt position and there have telescoping secondary legs to yield selective stable elevation to the firearm, barrel, etc.

DESCRIPTION OF PREFERRED EMBODIMENTS

Figure 1:
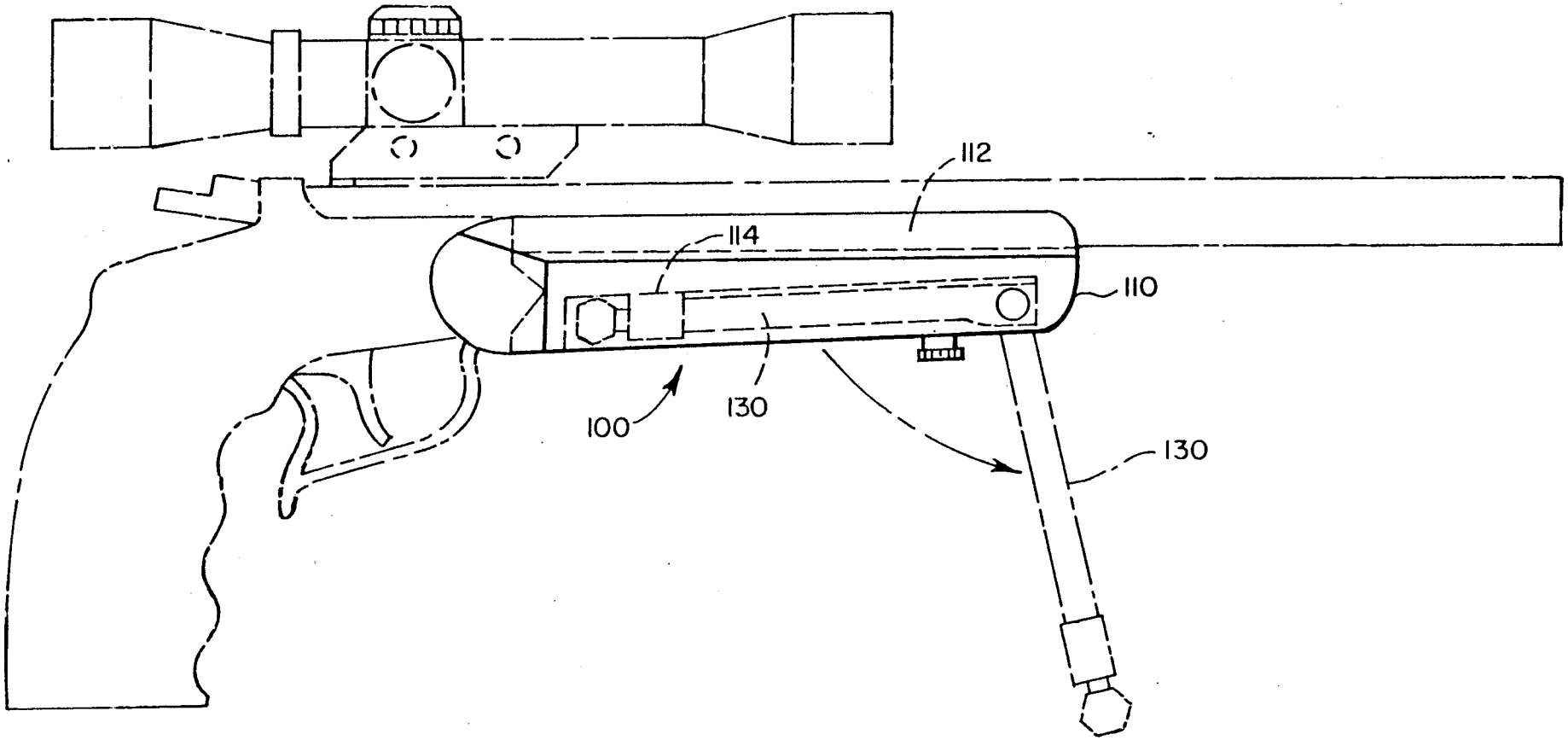
FIG. 1 is a view in side elevation of the invention where it is shown mounted upon the T/C Contender Shooting Piece; a portion of the forearm is broken away to reveal its interior storage capacity.

In FIG. 1, the invention is broadly designated 100 and includes in assembly the forearm 110 which defines in its upper portion an elongated top barrel channel cavity 112. In its lowermost portion, two similar cavities 114 are provided for collapsed retention of the bipod legs, on the one hand, and a connecting channel cavity 114' is provided for the bipod mount 120. At the rear end of the forearm 110 is a cutout 116 which is adapted to secure to the receiver of the pistol and to define apertures for locking thereto, in addition to the vertically extending screw means shown in FIG. 2. Clearly, because of channel cavity 112 and cutout 116, the resting of the barrel of the pistol in uppermost channel cavity 112 and the receiver in the cutout 116, will secure the pistol so that only one transversely set bolt-screw combination is required to hold the forearm 110 into position, relative to the pistol, per se.

Figure 2:
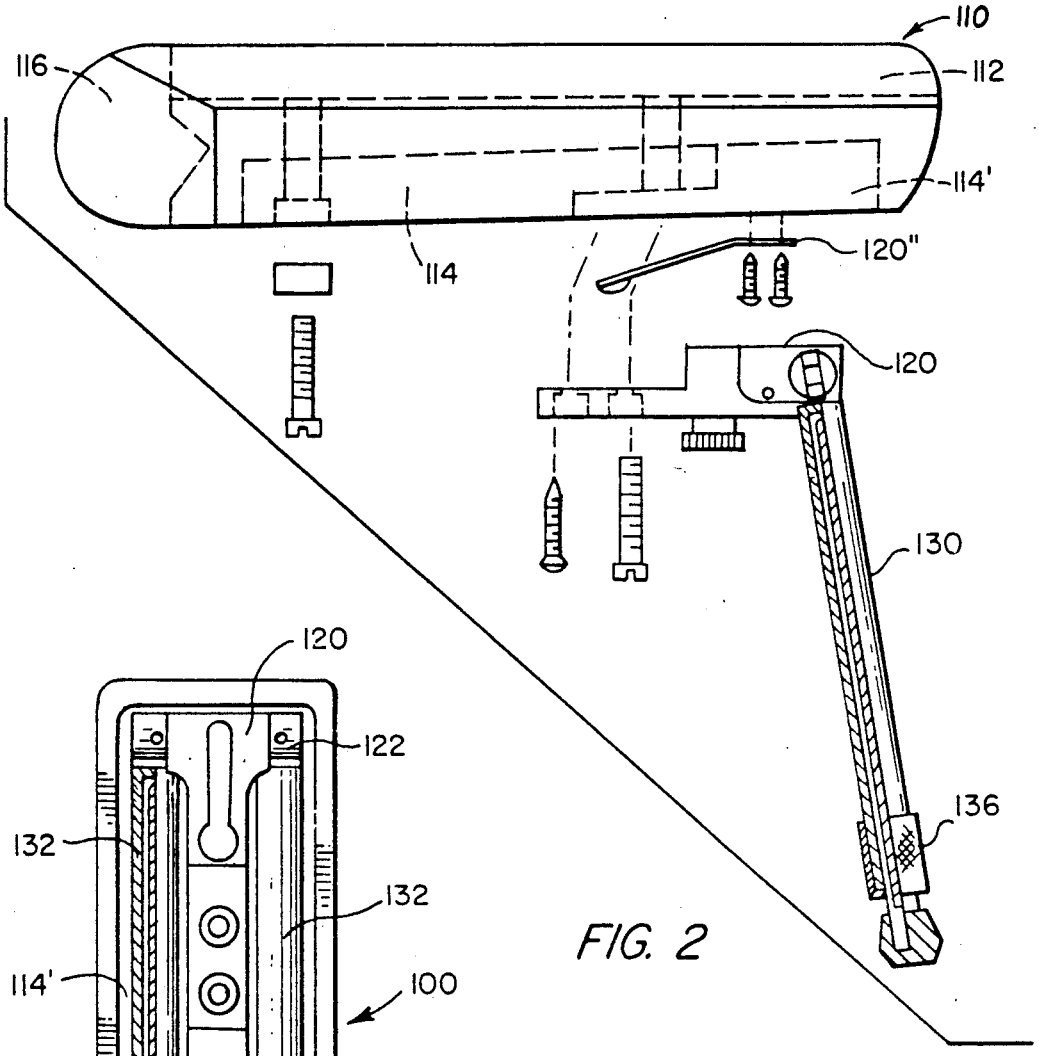
FIG. 2 illustrates the forearm and bipod elements, exploded in view with bipod legs extended.

Noting more specifically FIG. 2, the relative positioning of the cavities 112, 114–114' and 116 will be more evident. It will be apparent that bipod mount 120 is adapted to seat in its corresponding cavity 114' which is located adjacent the front of the forearm 110. This bipod mount 120 provides an axle bearing 120' at the foreward portion thereof and extending transversely of the bipod mount 120. Axle 122 has a fixed centermost portion set within the axle bearing 120', the extensions 122' being rotateable therein and providing bipod leg rotors; see FIG. 4.

Figure 2A:
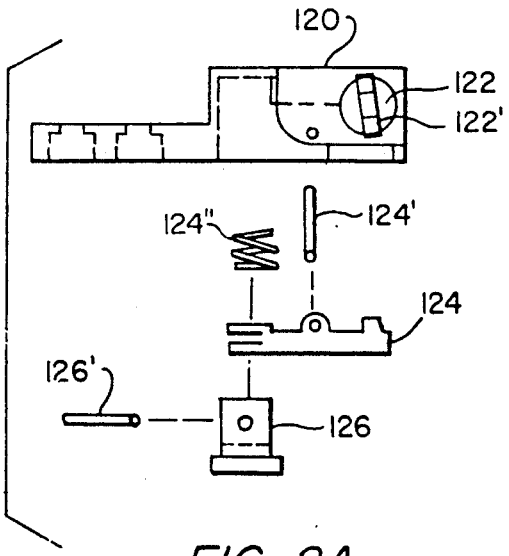
FIG. 2A is an exploded view of the elements forming the bipod mount.

Referring to FIG. 2A, the appropriate axle latch 124, together with latchpin 124' are all shown in exploded view relative to the bipod mount 120. Also bipod release button 126, and its axle-pin 126' appear therein. The bipod legs 130 are thus mounted in pivotal connection relative to the bipod mount. They include primary and secondary elements 132–134 as well as collets 136. See FIG. 3.

Figure 3:
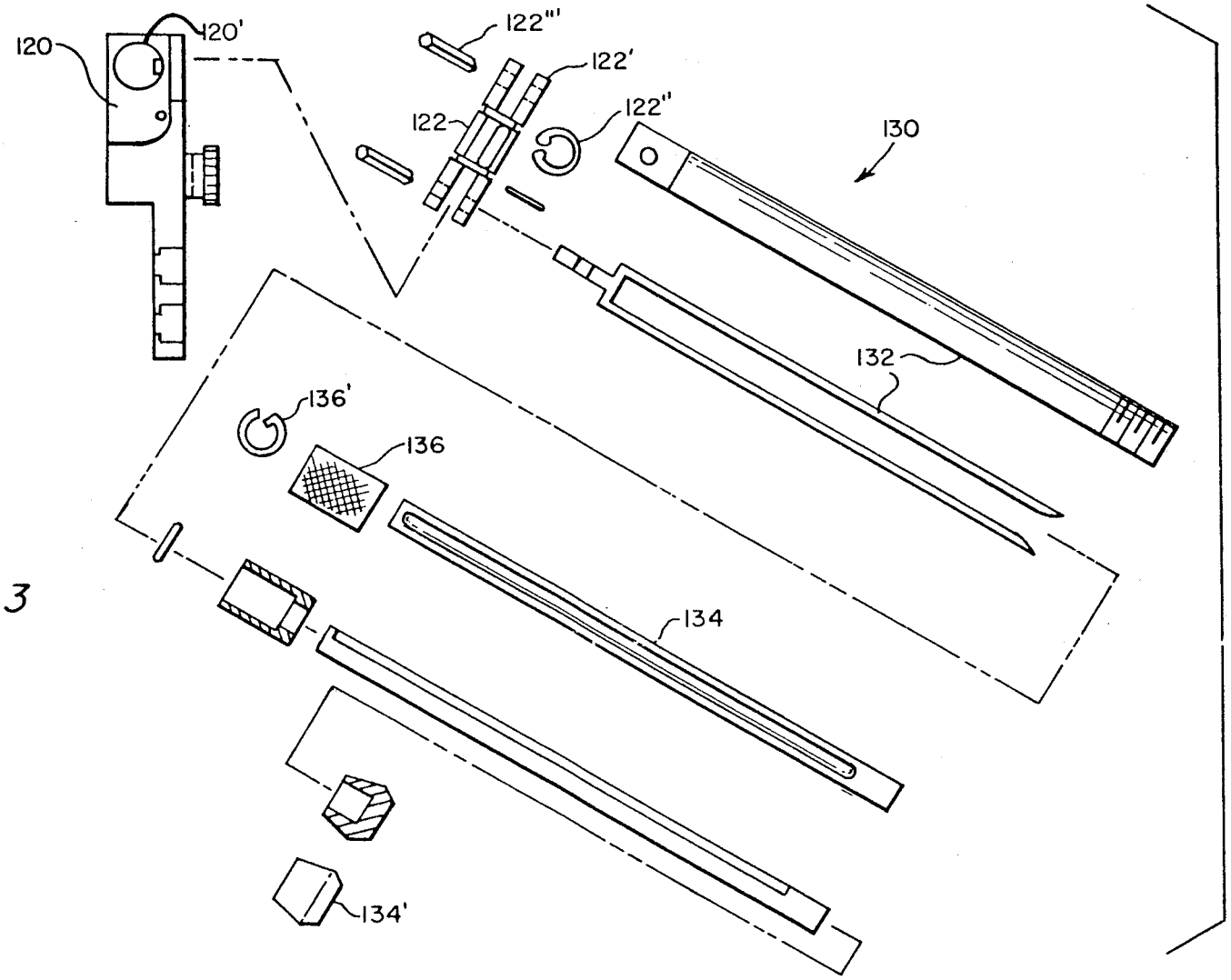
FIG. 3 is an exploded view of bipod with leg and axle assemblies.

FIG. 3 illustrates the relationship of primary legs 132 to corresponding telescoping legs 134 and the association of all to the mount 120 axle, 122, hereinafter described as to assembly thereof.

Figure 4:
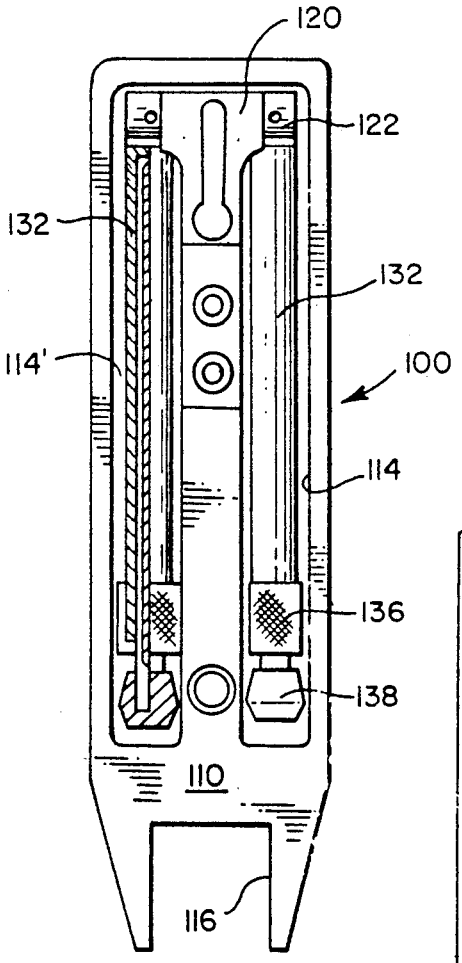
FIG. 4 is a bottom view of the invention, depicting the bipod in its fully retracted and collapsed position.

Referring to FIG. 4 like numerals refer to similar elements, reference FIGS. 2 & 3, aforesaid. This is a bottom view of the forearm 110, depicting the bipod legs rotateable upon the bipod mount 120

Assembly of Forearm/Bipod

FIG. 2A shows pin 126' inserted into the hole in slotted release button 126. The release button and pin are then slided over the axle latch 124 with the pins sliding into the slot cut into the end of the axle latch. The spring 124'' is placed into the hole into the bottom of the bipod mount with the axle latch and release button placed in the appropriate slot and hole above the spring; whereby the axle latch 124 is then pinned by pin 124' thus restraining this sub-assembly within the bipod body as shown in FIG. 3.

FIG. 3 being an exploded view of the completed bipod with the axle and leg assemblies illustrates how C-clip 122'' is snapped into the groove cut around axle 122. The release button 126 is depressed, raising the axle latch 124 in the bipod mount, clearing the hole through the side of the bipod body in which the axle is pushed through until the C-clip touches the side of the bipod mount. This then exposes the groove cut in the axle on the opposite side of the bipod mount, where the other C clip 122'' is snapped over the groove, eliminating lateral movement of the axle 122.

The flats that are cut on one end of the primary leg 132 are slid with the high side toward the bipod mount, with one of the slots cut into the axle 122, where they are each pinned with a roll pin 122''. The secondary leg 134 is now slid through the hole in the collet 136. The lock ring 136' is then snapped over the secondary leg 134 with the protusion falling into the slot milled into the secondary leg 134, keeping that leg 134 from falling out of the collet. This collet is then screwed onto the threaded end of the primary leg 132 where the secondary leg 134 can be slid up or down and locked into any position of elevation by tightening the collet 136, compressing the lock ring. Footpads 134' are then fitted onto the exposed ends of the secondary legs 134.

FIG. 4 as indicated is a bottom view of an assembled bipod with the legs in the up position, retracted for storage.

FIG. 2 being a side assembly view of the forearm and bipod, to assemble; a rear grommet is pushed into the rear hole of the forearm. Small wood screws are then introduced through the holes in the leg eject spring 120" and screwed into the leg channel cut into the forearm. The completed bipod is placed into the cutout and a wood screw is screwed into the rear hole of the bipod, thus keeping the assembly from falling out of the forearm when the barrel is changed. The two machine screws are then slid into their appropriate holes and screwed into lugs on the barrel of the Thompson/Center Contender not shown. This invention is adaptable to various other related firearms without departing from the spirit of invention, as depicted and claimed.

Operation

The collapsible bipod described is an integrated part of the forearm of a T/C Contender Super 14 Pistol. The metal mount and legs of the bipod are inlayed into the wooden forearm and attached thereto with a wood screw.

The legs are retractable into two respective leg channels cut into the wooden forearm where they are locked in the "up" position, out of sight. To release the legs, one presses the release button upward toward the pistol barrel, the bipod legs then fall straight out to 30 degrees below the bottom of the forearm and then continue forward, flaring out left and right to 30 degrees and locking in the extended forward position. With the legs in the locked position, the barrel is 5½" to 9¼" in elevation.

To retract leg extensions, twist-loosen the collets, slip the secondary leg extensions back into the primary legs and tighten the collets once again.

To retract the legs back into the forearm, one simply pushes the release button upward toward the sidearm barrel. With your hand push the legs back into the lower channels cut into the forearm wood where they will lock up into place.

Whereas the invention has been defined by way of example as adapted to the TC Contender Super Pistol, it is operable with various other related firearms, without departing from the spirit of invention, as defined and claimed herein.

I claim:

1. In combination with a sidearm, the improvement comprising:

A) a removable forearm having sidearm barrel, sidearm receiver and bipod channels defined exteriorly thereof;

B) a bipod mount and bipod secured within one channel of the forearm, said mount securing an axle for a bipod and means in the mount to lock and release a bipod;

C) a bipod axially engaging the bipod mount at a connecting end of the bipod;

C1) primary legs forming extensions of the bipod, said legs being axially extensible and retractable relative to the bipod mount and said primary legs containing secondary telescoping legs therein;

2. The combination of claim 1 further comprising in said bipod mount, means limiting forward tilt of the bipod legs upon extension thereof from retraction within the bipod mount.

3. The combination of claim 2 wherein said primary legs each define a collet which is engageable with a corresponding segment of each respective secondary leg, to alternately secure and release said secondary leg, to lengthen the bipod for increased elevation of the sidearm barrel, relative to a ground support.

* * * * *